United States Patent [19]

Splitt et al.

[11] 3,936,133

[45] Feb. 3, 1976

[54] CONNECTOR BLOCK FOR TELEPHONE EQUIPMENT

[75] Inventors: Frank G. Splitt, Arlington Heights; William P. Frantz, Chicago, both of Ill.

[73] Assignee: Cook Electric Company, Morton Grove, Ill.

[22] Filed: Jan. 17, 1974

[21] Appl. No.: 434,129

[52] U.S. Cl. ..... 339/198 R; 317/99; 339/18 R

[51] Int. Cl.[2] ..... H01R 9/00

[58] Field of Search ..... 339/198 R, 198 G, 18 R, 339/18 B, 14 R, 14 L, 14 P; 317/122, 99

[56] References Cited

UNITED STATES PATENTS

| | | | |
|---|---|---|---|
| 1,639,310 | 8/1927 | Richardson | 339/198 R |
| 2,643,363 | 6/1953 | Robertson et al. | 339/14 L |
| 3,088,055 | 4/1963 | Schwing | 317/122 |
| 3,518,611 | 6/1970 | Shores, Jr. | 339/18 R |
| 3,543,216 | 11/1970 | Vanderbeek | 339/14 R X |

*Primary Examiner*—Joseph H. McGlynn
*Assistant Examiner*—James W. Davie
*Attorney, Agent, or Firm*—Mason, Kolehmainen, Rathburn & Wyss

[57] ABSTRACT

A connector block for mounting plug-in type protector assemblies to protect telephone equipment from high voltage and current surges occurring on incoming telephone lines includes an elongated, relatively narrow mounting panel having a mounting end portion at either end. Disposed along the mounting panel is a plurality of socket groups arranged in a single column and a plurality of terminal hole groups arranged in a single column adjacent the socket groups, each of the terminal hole groups being associated with one of the socket groups. Each of the socket groups contains four line terminal contacts and a ground terminal contact. The ground terminal contact in each of the socket groups has a holder portion extending from a rear face of the mounting panel to which is coupled a single ground terminal bus bar. The ground terminal bus bar is coupled to grounding plates positioned adjacent the rear of each of the end portions. In one embodiment, a fanning strip is detachably mounted to the end portions so as to be positioned along a side of the mounting panel to protect conductors coupled to contacts or terminals in the sockets or terminal holes.

4 Claims, 12 Drawing Figures

FIG. 9
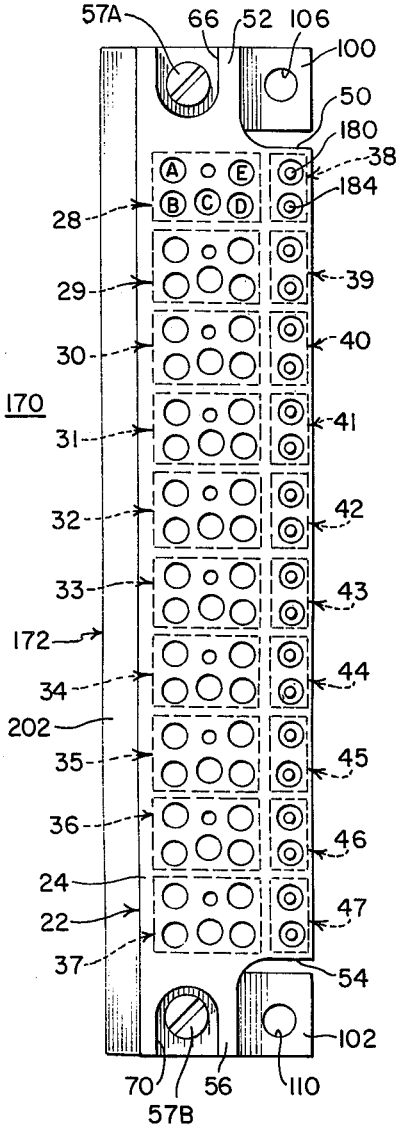
FIG. 10
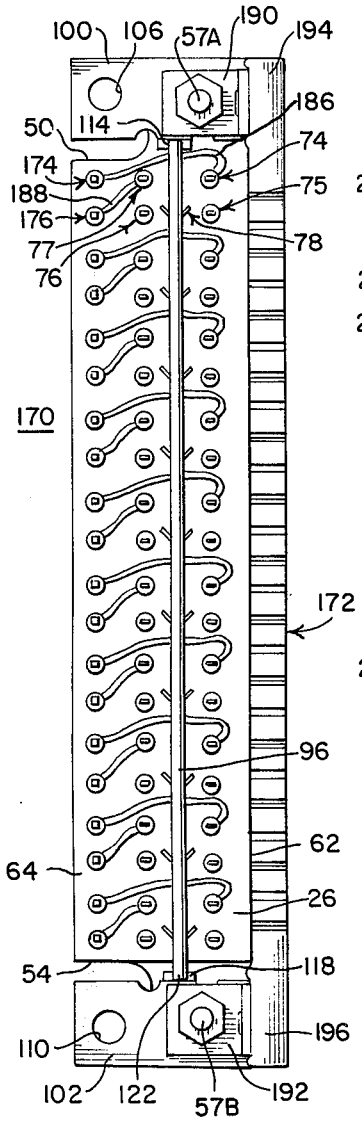
FIG. 11
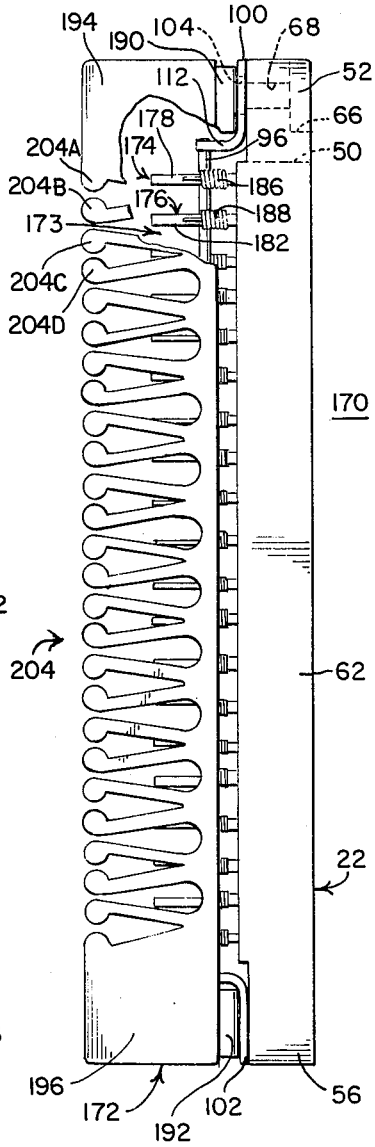
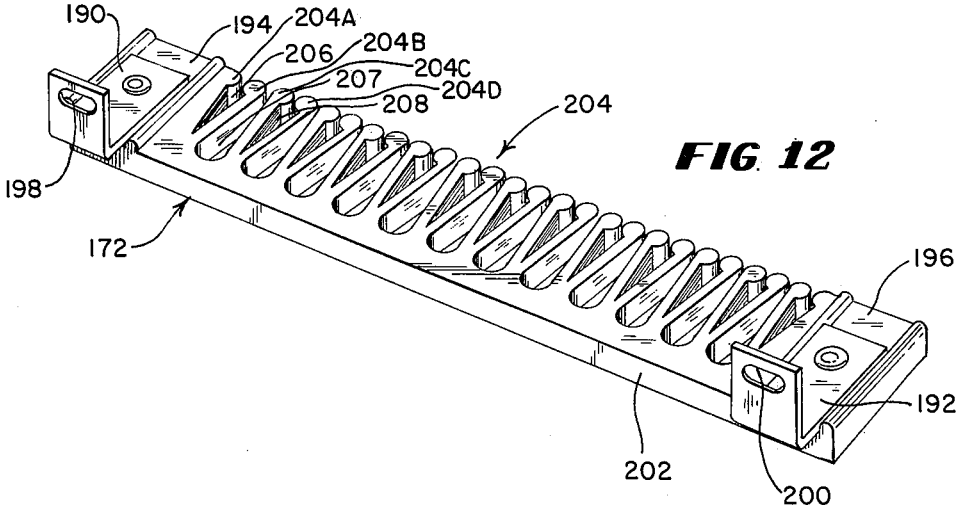
FIG. 12

CONNECTOR BLOCK FOR TELEPHONE EQUIPMENT

This invention relates to a connector block used in mounting plug-in type protector assemblies associated with telephone equipment and, more particularly, to a new and improved connector block used primarily when a small number of plug-in type protector assemblies are required.

Each telephone line in a telephone system must be protected from high voltage and current surges that might occur on the telephone lines and that could damage telephone equipment to which the lines are coupled. Normally, for each pair of telephone lines, a plug-in type protector assembly is utilized to connect the pair of incoming lines to telephone equipment, such as central office switching equipment and private branch exchanges. The protector assembly contains a pair of arresters, each of which are coupled between one of the telephone lines and a ground terminal. When a high voltage or current surge occurs on one of the telephone lines, a spark gap in the arrester coupled to that line sparks over so that the telephone line is coupled directly to the ground terminal through the arrester and the telephone equipment is protected from a damaging potential.

For incoming telephone lines coupled to telephone central office equipment, the plug-in type protector assemblies are mounted on a connector block such that the connector block serves as an electrical interface between the incoming telephone lines and the central office switching equipment. One such type of connector block utilized in telephone central offices is disclosed in U.S. Pat. No. 3,518,611. The connector block disclosed in that patent provides for the mounting of up to one hundred plug-in type protector assemblies. The protector assemblies are arranged in rows and columns with cross-connect wire terminals and a fanning strip adjacent to protector assemblies and a test field along the top edge of the connector block. Although the specific geometry of that connector block helps facilitate the orderly and efficient handling of wires coupling the incoming lines to a telephone central office, the connector block occupies an appreciable amount of space.

Another type of connector block used in telephone central offices is disclosed in a copending application, Ser. No. 336,265, filed Feb. 27, 1973 and now abandoned, which is assigned to the same assignee of record in the present application. The connector block disclosed in that application also is capable of mounting up to 100 plug-in type protector assemblies. However, due to the design of that connector block, the connector block occupies a lesser amount of space in a telephone central office that the connector block disclosed in U.S. Pat. No. 3,518,611.

Nevertheless, both of the above-mentioned connector blocks occupy too much space when used in small types of protection applications. For example, telephone lines and the equipment connected thereto in private branch exchanges (PBX), Carrier, and Special Service circuits also must be protected from high voltage and current surges which occur on the telephone lines. In such applications, it is necessary to place a connector block within relatively small spaces in PBX cabinets or the like. In those instances, it would be desirable to have a connector block of relatively small size capable of mounting a small quantity of plug-in type protector assemblies.

Accordingly, objects of the present invention are to provide a new and improved connector block for use in small types of protection applications for telephone lines and telephone equipment; to provide a new and improved connector block of a relatively small size to fit within smaller types of telephone equipment to provide a new and improved connector block to which is readily attached a detachable fanning strip; and to provide a new and improved ground terminal bus for a connector block.

In accordance with these and many other objects, an embodiment of the present invention comprises a connector block for mounting plug-in type protector assemblies which couple incoming telephone lines to telephone equipment and which protect the incoming telephone lines and telephone equipment from high voltage and current surges that might occur on the lines. The connector block consists primarily of a relatively narrow, generally elongated, rectangular mounting panel having a plurality of socket groups arranged in a single column along the mounting panel and having a plurality of terminal hole groups arranged in a single column adjacent the socket groups, each of which terminal hole groups being associated with one of the socket groups.

Each of the socket groups has five sockets. In four of these sockets, line terminal contacts are disposed that extend from a rear face of the mounting panel and that receive line pins of one of the protector assemblies plugged into a front face of the mounting panel. In the other socket, a ground terminal contact is disposed that also extends from the rear face of the mounting panel and that receives a ground pin of each of the protector assemblies. The ground terminal contacts extend from the rear face of the mounting panel in such a manner that a single ground terminal bus bar is readily coupled to each of the ground terminal contacts. Each of the pin terminal holes are capable of receiving a terminal for connecting cross-connect jumper wires or test equipment to the incoming telephone lines.

At either end of the mounting panel and in general alignment with the socket groups is a projecting end portion with a mounting hole therein to receive fasteners to attach the connector block to a mounting bracket. In addition, at either end of the mounting panel is a ground plate which is positioned adjacent to a rear portion of the projecting end portion, is coupled to the ground terminal bus bar and has a pair of ground holes. One ground hole is aligned with the mounting hole and the other is located adjacent the mounting hole and receives fasteners to attach the ground plate to a ground terminal. Also connectable to the end portions is a fanning strip that is positioned adjacent the rear face of the mounting panel to protect wires being connected to the line terminal contacts.

Many other objects and advantages of the present invention will become apparent from considering the following detailed description in conjunction with the drawings in which:

FIG. 9 is a front view of still another embodiment of the connector block shown in FIG. 1 together with a fanning strip attached to the connector block;

FIG. 10 is a rear view of the connector block of FIG. 9;

FIG. 11 is a side view of the connector block of FIG. 9 with the fanning strip partially cut away; and FIG. 12 is a perspective view of the fanning strip attached to the connector blocks of FIGS. 9–11.

Figure 1:
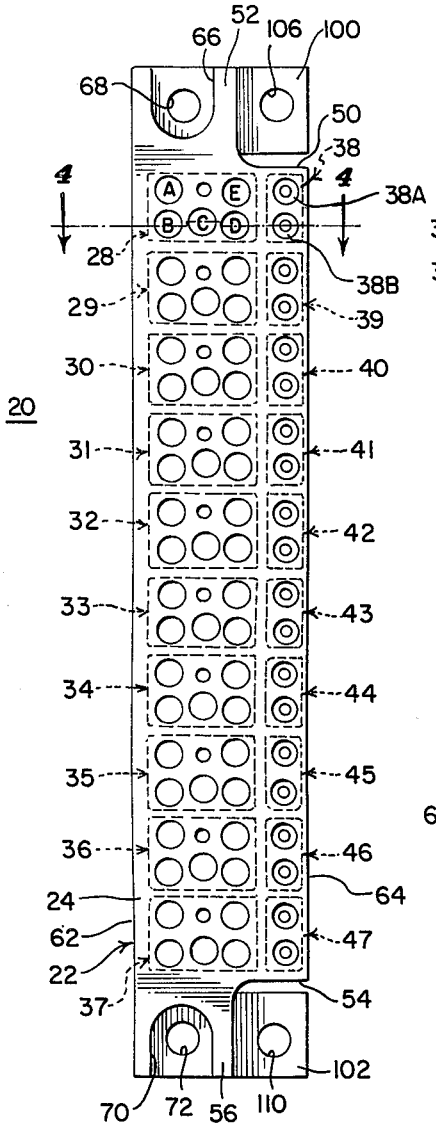
FIG. 1 is a front view of a connector block embodying the present invention.
Figure 2:
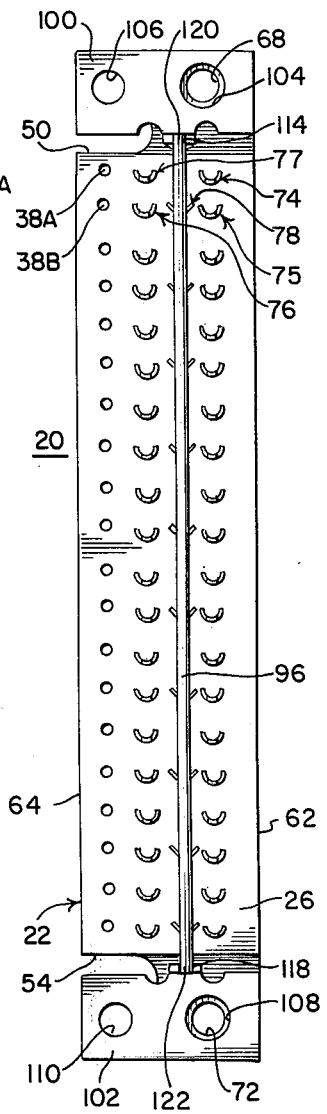
FIG. 2 is a rear view of the connector block of FIG. 1.

Referring now more specifically to FIGS. 1–5 of the drawings, there is illustrated a connector block which is indicated generally as 20 and which embodies the present invention. The connector block 20 consists primarily of a mounting panel or housing 22 having a front face or side 24 and a rear face or side 26 with ten groups of sockets 28–37 and ten groups of terminal holes 38–47 extending through the mounting panel 22 between the front face 24 and the rear face 26. Projecting from a top edge 50 of the mounting panel 22 is an end portion 52 and projecting from a bottom edge 54 of the mounting panel 22 is an end portion 56. The connector block 20 is readily mountable by screws 57A and 57B on a bracket 58 when used in a private branch exchange (PBX) or on other appropriate types of brackets, such as main frame brackets, wall mounting brackets or relay brackets (not shown), when used in other applications. The relatively small size of the connector block 20 enables the mounting of plug-in type protector assemblies, such as protector assembly 60 shown in FIG. 5, in a relatively small space. This is particularly advantageous for small types of protection applications, such as Private Branch Exchanges, Carrier, and Special Service circuits.

The mounting panel 22 is made of an insulating material, such as a thermal plastic polycarbonate resin that has a desirable combination of toughness, impact strength, heat resistance, dimensional stability, and good insulating properties. The mounting panel 22 is generally rectangular and elongated in shape, with the length of the mounting panel 22 between its top edge 50 and its bottom edge 52 being substantially greater than the width of the mounting panel 22 between its side edges 62 and 64. The relatively narrow, elongated shape of the mounting panel 22 facilitates the mounting of the connector block 20 when used in small types of protection applications.

The connector block 20 is mounted on the bracket 58 by extending the mounting screws 57A and 57B (FIG. 5) through the end portions 52 and 56 into the bracket 58. More specifically, the edge portion 52 has a generally U-shaped recess 66 with a mounting hole 68 extending from the recess 66 to the rear of the end portion 52. Similarly, the end portion 56 has a generally U-shaped recess 70 with a mounting hole 72 extending from the recess 70 through the remaining portion of the end portion 56. The recesses 66 and 70 shield the heads of the mounting screws 57A and 57B, respectively, so that the screws 57A and 57B do not hinder any work being done on the connector block 20.

The socket groups 28–37 are aligned on the mounting panel 22 adjacent the side edge 62 between the top edge 50 and the bottom edge 54. As illustrated in connection with the socket group 28, each of the socket groups 28–37 consists of five sockets or holes 28A–E extending through the mounting panel 22. The sockets 28A–E are generally cylindrical in shape, but near the rear face 26 of the mounting panel 22 become generally U-shaped. The shaping of the sockets 28A–E in this manner enables line terminal contacts 74–77 to be readily insertable into the sockets 28A, 28B, 28D and 28E, respectively, and a ground terminal contact 78 to be readily insertable into the socket 28C.

Figure 3:
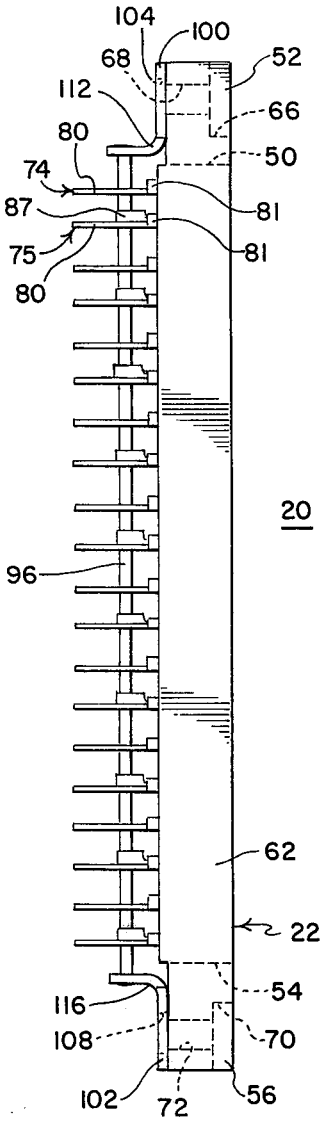
FIG. 3 is a side view of the connector block shown in FIG. 1.
Figure 4:
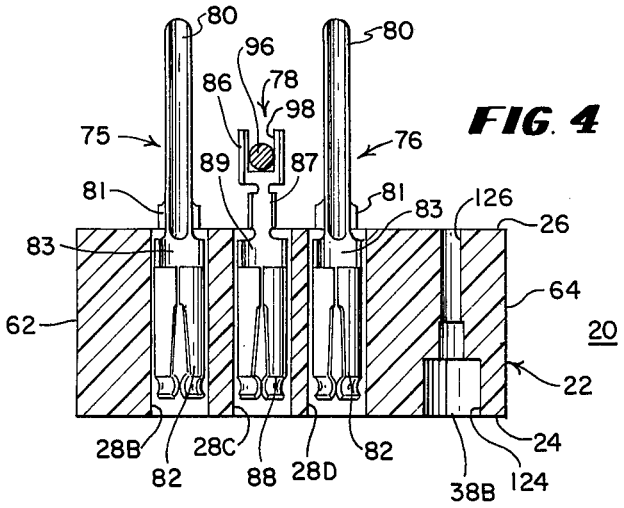
FIG. 4 is a cross-sectional view of the connector block shown in FIG. 1 taken along line 4—4 of FIG. 1.
Figure 5:
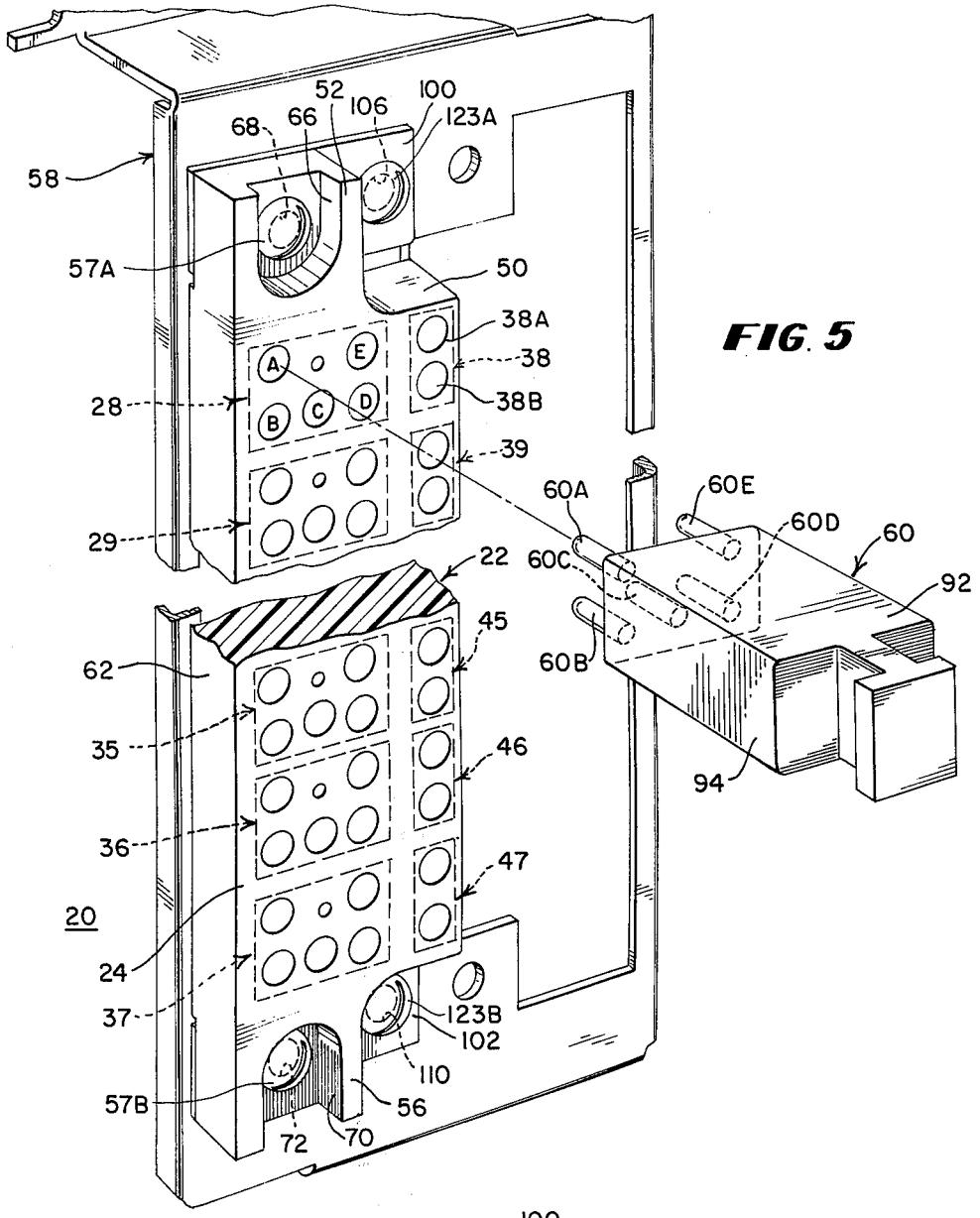
FIG. 5 is a partially cut away, front perspective view of the connector block shown in FIG. 1 mounted on a mounting bracket and illustrating a plug-in type protector assembly being plugged into the connector block.

The line terminal contacts 74–77 are identical and as best seen in FIGS. 3 and 4, each of the line terminal contacts 74–77 has a wire wrap portion 80 with a generally U-shaped flange portion 81 projecting from the rear face 26 and a receptacle or spring contact portion 82 with a generally U-shaped flange portion 83 disposed in the cylindrical portion of the sockets 28A, 28B, 28D and 28E. The line terminal contacts 74–77 are disposed in the sockets 28A, 28B, 28D and 28E, respectively, by inserting the wire wrap portions 80 together with the flange portions 81 of the line terminal contacts 74–77 through the cylindrical and U-shapaed portions of the sockets 28A, 28B, 28D and 28E. When the flange portions 83 abut against the rear U-shaped portion of the sockets 28A, 28B, 28D and 28E, the flange portions 81 are then crimped or flared to retain the line terminal contacts 74–77 within the sockets 28A, 28B, 28D and 28E, respectively.

On the other hand, and as best seen in FIGS. 3 and 4, the ground terminal contact 78 located in the socket 28C includes a ground terminal bus bar holder 86 with a generally U-shaped flange portion 87 projecting from the rear face 26 of the mounting panel 22 and a receptacle 88 with a generally U-shaped flange portion 89 located within the cylindrical portion of the socket 28C. In order to position the ground terminal contact 78 in the socket 28C, the ground bus bar holder 86 together with the flange portion 87 is inserted through the cylindrical and U-shaped portions of the socket 28C so that the flange portion 89 abuts against the rear U-shaped portion of the socket 28C. Thereafter, the flange portion 87 is crimped or flared slightly so as to maintain the ground terminal contact 78 properly positioned in the socket 28C.

The protector assembly 60 is plugged into the socket group 28 by inserting pins 60A, 60B, 60D and 60E extending from the protector assembly 60 into the receptacle portions 82 of the line terminal contacts 74–77, respectively, and inserting a pin 60C on the protector assembly 60 into the receptacle portion 88 of the ground terminal contact 78. With the protector assembly 60 inserted into the socket group 28, the protector assembly 60 has a relatively long side 92 disposed in a generally horizontal direction along and generally parallel to the width axis of the mounting panel 22. Another or a short side 94 of the protector assembly 60 is positioned vertically along the vertical axis of the mounting panel 22. The mounting of the protector assembly 60, as well as similar protector assemblies in the socket groups 29–37, in this manner minimizes the amount of space the connector block 20 occupies between the edges 50 and 54.

As will be discussed in more detail hereinafter, incoming telephone lines are coupled to the wire wrap portions 80 of the line terminal contacts 74 and 77 and jumper wires for telephone switching equipment or the like are coupled to the wire wrap portions 80 of the line terminal contacts 75 and 76. The protector assembly 60 not only connects the line terminal contact 74 to the line terminal contact 75 and the line terminal contact 76 to the line terminal contact 77, but also protects the telephone equipment connected to the line terminal contacts 75 and 76 from high voltage and current surges that might occur on the lines coupled to the line terminal contacts 74 and 77.

More specifically, the pins 60A and 60B are shorted together in the protector assembly 60 so as to couple the line terminal contact 74 to the line terminal contact 75. Likewise, the pins 60D and 60E are shorted together so as to couple the line terminal contact 76 to the line terminal contact 77. In addition, the pins 60A and 60B are coupled to the protector assembly 60 to the pin 60C by an arrester and the pins 60D and 60E are coupled to the pin 60C by another arrester in the protector assembly 60. Whenever a high voltage or current surge occurs on the line coupled to the line terminal contact 74, a spark gap in the arrester between the pins 60A–B and the pin 60C sparks over so as to short the pins 60A–B and 60C together. In a similar manner, the arrester between the pins 60D–E and the pin 60C sparks over as a result of a high voltage or current surge on the line coupled to the line terminal contact 77 so that the pins 60D–E and the pin 60C are shorted together. By coupling the pin 60C to a ground terminal through the ground terminal contact 78, the equipment coupled to the line terminal contacts 75 and 76 are protected from the high voltage and current surges occurring on the lines coupled to the line terminal contacts 74 and 77, respectively.

In order to connect the ground terminal contact 78 to the ground terminal (not shown), a conductive ground bus bar 96, which in the disclosed embodiment is generally round in shape, is insertable into a notch 98 in the ground bus bar holder portion 86. Since the socket groups 28–37 are in vertical alignment along the mounting panel 22, the notch 98 in the ground terminal contact 78 in each of the socket groups 28–37 are in vertical alignment so that the ground bus bar 96 is readily insertable into each of the notches 98. The ground bus bar 96 is secured in the notches 98 by soldering or the like.

Thus, the ground bus bar 96 extends along the rear face 26 of the mounting panel 22 toward conductive grounding plates 100 and 102 positioned adjacent to the rear portion of the end portions 52 and 56, respectively. The ground plate 100 has a pair of holes 104 and 106, the hold 104 being in coaxial alignment with the mounting hole 68. Likewise, the ground plate 102 has a pair of holes 108 and 110, the hole 108 being in coaxial alignment with the mounting hole 72. The ground plate 100 has a bracket 112 with a notch 114 therein projecting transverse to the ground plate 100 whereas the ground plate 102 has a bracket 116 with a notch 118 therein projecting transverse to the ground plate 102. The ground bus bar 96 is coupled to the ground plates 100 and 102 by placing end portions 120 and 122 of the ground bus bar 96 into the notches 114 and 118, respectively. The end portions 120 and 122 are secured in the notches 114 and 118, respectively, by soldering or the like.

The ground plates 100 and 102 in turn are coupled to the bracket 58 by the mounting screw 57A insertable through the mounting hole 68 and the hole 104 and the mounting screw 57B insertable through the mounting hole 72 and the hole 108. In this manner, the mounting of the connector block 20 to the bracket 58 also couples the ground plates 100 and 102 to the bracket 58. Since the bracket 58 is coupled to a ground terminal, the ground bus bar 96 also is grounded. If it is desired to connect the ground plates 100 and 102 to other such ground plates on other similar connector blocks adjacent to the connector block 20, screws 123A and 123B can be insered through the holes 106 and 110 and coupled to the other plates or ground terminals by appropriate ground straps.

Associated with each of the socket groups 28–37 is one of the terminal hole groups 38–47, respectively. The terminal hole groups 38–47 are located between the socket groups 28–37 and the side edge 64 of the mounting panel 22 and are vertically aligned between the top and bottom edges 50 and 54. As illustrated in connection with the terminal hole group 38, which is associated with the socket group 28, each of the terminal hole groups 38–47 has a pair of terminal holes 38A and 38B. The holes 38A and 38B are identical and, as best seen in FIG. 4 with respect to the hole 38B, extend between the front and rear faces 24 and 26 of the mounting panel 22. The hole 38B is generally cylindrical in shape with a relatively large diameter portion 124 adjacent the front face 24 of the mounting panel 22 and a relatively small diameter portion 126 extending from the large diameter portion 124 to the rear face 26 of the mounting panel 22. As will be discussed in connection with FIGS. 6–8, wire wrap terminals are insertable into the terminal holes 38A and 38B or as will be discussed in connection with FIGS. 9–12, test point terminals are insertable into the terminal holes 38A and 38B.

Figure 6:
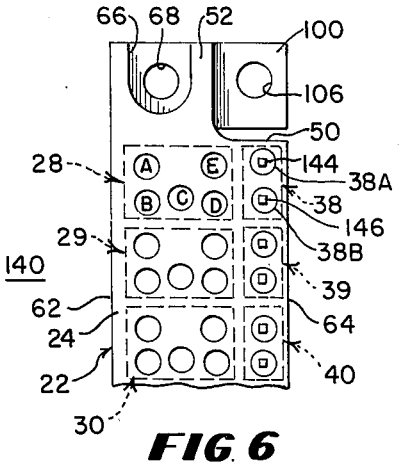
FIG. 6 is a partial front view of an alternate embodiment of the connector block shown in FIG. 1.
Figure 7:
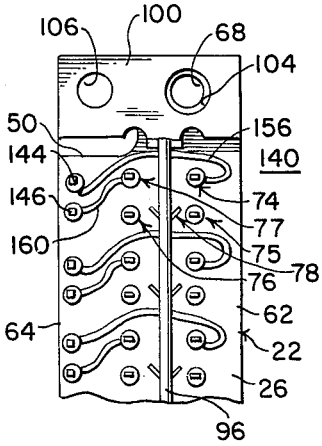
FIG. 7 is a partial rear view of the connector block of FIG. 6.
Figure 8:
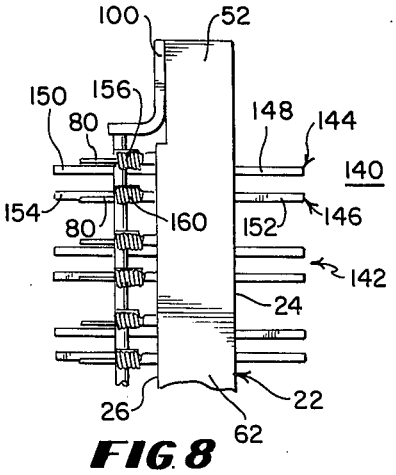
FIG. 8 is a partial side view of the connector block of FIG. 6.

Referring now to FIGS. 6–8, therein is disclosed a connector block 140 partially cut away that is substantially identical to the connector block 20 shown in FIGS. 1–5. The various portions of the connector block 140 that are identical with corresponding portions of the connector block 20 are designated by the same reference numerals as those portions of the connector block 20. As previously indicated, wire wrap pin terminals 142 are inserted into each of the terminal holes in the terminal groups 38–47.

With particular reference to wire wrap pin terminals 144 and 146 disposed in the terminal holes 38A and 38B, respectively, the wire wrap pin terminals 144 and 146 are standard, generally rectangular terminals that are designed to be securely mounted within the small diameter portion 126 of the pin terminal holes 38A and 38B. The wire wrap pin terminal 144 has a pin portion 148 projecting from the front face 24 of the mounting panel 22 and a pin portion 150 projecting from the rear face 26 of the mounting panel 22. Similarly, the wire wrap pin terminal 146 has pin portions 152 and 154 projecting from the front face 24 and the rear face 26, respectively, of the mounting panel 22.

As best seen in FIG. 7 in connection with the wire wrap pin terminals 144 and 146, each of the wire wrap pin terminals 142 are coupled to the line terminal contacts 74 and 77 in the socket groups 28–37. To so couple the wire wrap pin terminals 144 and 146, a jumper wire 156 couples the line terminal contact 74 to the wire wrap pin terminal 144 by wire wrapping the end portion of the jumper wire 156 to the wire wrap portion 80 of the line terminal contact 74 and to the pin portion 150 of the wire wrap pin terminal 144. Similarly, a jumper wire 160 couples the line terminal contact 77 to the wire wrap pin terminal 146. In this manner, the wire wrap pin terminals 144 and 146 are coupled to incoming telephone lines which are connected to the line terminal contacts 74 and 77, respectively. If it is necessary to test such incoming telephone lines coupled to the line terminal contacts 74 and 77, test equipment is connected to the wire wrap pin terminals 144 and 146 by making wire wrap connections from the test equipment to the pin portions 148 and 152 projecting from the front face 24 of the mounting panel 22. Thus, the connector block 20 is readily converted to the connector block 140 by merely inserting the wire wrap pin terminals 142 in the terminal holes of the terminal hole groups 38–47 so that incoming telephone lines can be readily tested.

On the other hand, the jumper wire 156 can be connected between the wire wrap pin terminal 144 and the line terminal contact 75 and the jumper wire 160 can be connected between the wire wrap pin terminal 146 and the line terminal contact 76. By so connecting the jumper wires 156 and 160, as well as the jumper wires associated with the other terminal hole groups 39–47 and the other socket groups 29–37, in this alternate fashion, telephone wires from telephone switching equipment or the like can be coupled on the front of the connector block 140 to the incoming lines associated with the line terminal contacts 74 and 77. This is accomplished by wire wrapping such wires to the pin portions 148 and 152 projecting out from the front face 24 of the mounting panel 22.

Referring now to FIGS. 9–11, another form of the connector block 20, connector block 170, is disclosed therein. The connector block 170 is substantially identical to both the connector blocks 20 and 140 and the various portions of the connector block 170 that are identical to corresponding portions on the connector block 20 are designated by the same reference numerals as those portions of the connector block 20. The connector block 170 also has a detachably mounted fanning strip 172 affixed to the end portions 52 and 56 so as to be disposed adjacent the side edge 62 of the mounting panel 22. The fanning strip 172 is also shown in FIG. 12 and can be as readily attached to the connector blocks 20 and 140 as well as the connector block 170.

As previously indicated, the terminal holes in the terminal hole groups 38–47 on the connector block 170 contain test point terminal pins 173. The test point terminal pins 173 are coupled to the line terminal contacts 74 and 77 in each of the socket groups 28–37 in the same manner as the test point terminal pins 174 and 176 disposed in the pin terminal holes 38A and 38B are coupled to the line terminal contacts 74 and 77 in the socket group 28. More specifically, the test point pin terminal 174 has a pin portion 178 extending through the small diameter portion 126 of the pin terminal hole 38A and out from the rear face 26 of the mounting panel 22 and a generally round head portion 180 that is positioned within the large diameter portion 124 of the pin terminal hole 38A. Likewise, the test point pin terminal 176 has a pin portion 182 extending through the small diameter portion 126 of the pin hole 38B and out from the rear face 26 of the mounting panel 2 and a generally round head portion 184 positioned in the large diameter portion 124 of the pin terminal hole 38B.

As seen in FIG. 10, the pin portion 178 of the test point pin terminal 174 is coupled by a jumper wire 186 to the line terminal contact 74 whereas the pin portion 182 of the test point pin terminal 176 is coupled to the line terminal contact 77 by a jumper wire 188. By making these connections with the jumper wires 186 and 188, the test point pin terminal 174 is directly coupled to the incoming line associated with the line terminal contact 74 and the test point pin terminal 176 is directly coupled to the incoming line associated with the line terminal contact 77. If such incoming telephone lines are to be tested, test plugs from test equipment can be coupled to the head portions 180 and 184 of the test point pin terminals 174 and 176, respectively, within the large diameter sections 124 of the pin terminals holes 38A and 38B. In this manner, the incoming lines readily are tested by such equipment from the front portion of the mounting panel 22.

In many instances, it is beneficial to protect wires being connected to the connector blocks 20, 140 and 170 and to maintain these wires in an orderly fashion relative to the socket groups 28–37 and the terminal hole groups 38–47. The fanning strip 172 shown in FIGS. 9–12 accomplishes this purpose.

The fanning strip 172 has angular brackets 190 and 192 at either end that are attached to end portions 194 and 196, respectively, of the fanning strip 172. The angular brackets 190 and 192 have mounting holes 198 and 200 that can be aligned with the mounting holes 68 and 72 extending through the end portions 52 and 56 of the connector block 170 and the holes 104 and 108 in the grounding plates 100 and 102. In this manner, the fanning strip 172 is connected to the connector block 170 adjacent the edge 62 by the same mounting screws 57A and 57B attaching the connector block 170 to the bracket 58. Of course, the fanning strip 172 can be mounted adjacent the edge 64 of the connector block 170 by aligning the mounting holes 198 and 200 with the holes 110 and 106, respectively, and inserting appropriate fasteners through the aligned holes. Extending between the end portions 194 and 196 is a bar 202 from which extends flexible resilient fingers 204. The fingers 204 form gates, such as the gates 206–208 formed by fingers 204A–D, through which gates 206–208 are insertable the wires being connected to the line terminal contacts 74–77 in the socket group 28. By having the fanning strip 172 detachably mountable to the connector block 170, the fanning strip 172 can be connected to the connector block 170 whenever the wires connected to the connector block 170 could be damaged and whenever a more efficient handling of the wires is desired.

Although the present invention is described with reference to several illustrative embodiments thereof, it should be understood that numerous other modifications and embodiments of the invention can be devised by those skilled in the art that will fall within the spirit and scope of the principles of this invention.

We claim:

1. A connector to be mounted on a bracket frame structure for mounting a plurality of plug-in type protector assemblies used in protecting pairs of telephone lines and telephone equipment, each of which protector assemblies having line terminals and a ground terminal, said connector comprising:

an elongated mounting panel having first and second elongated sided edges, a first mounting end portion at one end of the panel and a second mounting end portion at an opposite end of the panel, and first and second opposed mounting faces, a plurality of socket groups arranged in a single column along said mounting panel adjacent said first elongated side edge, each of said socket groups have an array of sockets conforming to said array of line terminals and ground terminal so as to mount one of said protector assemblies in each of said socket groups, a plurality of terminal hole groups arranged in a single column along said mounting panel adjacent said column of socket groups and adjacent said second elongated side edge, each of said terminal hole groups being adjacent and associated with one of said socket groups, a ground terminal contact means insertable into one of said sockets in each of said socket groups, each of said ground terminal contact means having a receptacle portion in said mounting panel to receive said ground terminal of said protector assembly, and a holding portion extending from said second face of said mounting panel, a first ground plate mounted along said second face of said mounting panel at said first end portion, said first ground plate having a first bracket means extending from said second face of said mounting panel and in alignment with said holding portions of each of said ground terminal contact means, a second ground plate mounted along said second panel face at said second end portion and having a second bracket means in alignment with said first bracket means and said holding portions, ground bus bar means extending along said second face and connected to each of said holding portions of said ground terminl contact means and said first and second bracket means of said first and second ground plates, a mounting hole in each of said first and second mounting end portions, a fastener insertable through each of said mounting holes to connect said mounting panel to said bracket frame structure, and a ground hole in each of said first and second ground plates in coaxial alignment with each of said mounting holes.

2. The connector as set forth in claim 1 including a fanning strip having a plurality of flexible, resilient fingers forming a plurality of gates, said fanning strip being securable adjacent said mounting panel along one of said elongated side edges.

3. A connector for mounting plug-in type protector assemblies having terminals extending therefrom, said connector comprising:

a mounting panel having first and second mounting end portions, first and second elongated side edges and first and second opposed faces, a plurality of socket groups arranged in a single column along said mounting panel from said first mounting end portion to said second mounting end portion and adjacent one of said first elongated side edges, each of said socket groups having sockets arranged so as to mount one of said protector assemblies in each of said socket groups, a plurality of terminal hole groups arranged in a single column adjacent said column of socket groups and adjacent said second elongated side edge, each of said terminal hole groups being positioned next to one of said socket groups so as to be associated with said socket groups, first and second ground plates mounted along said second face of said panel adjacent each of said first and second end portions, respectively, each of said ground plates having at least one ground hole therethrough, and a fanning strip having a plurality of gates, which plurality of gates is formed by a plurality of resilient flexible fingers, said fanning strip having first and second mounting brackets at each end of said fanning strip so that said first mounting bracket can be detachably fixed to said first ground plate and said second mounting bracket can be detachably fixed to said second ground plate.

4. The connector as set forth in claim 3 wherein said first and second mounting brackets each are angular brackets and each have a fanning strip hole to be aligned with said ground holes for mounting said fanning strip along one of said first and second elongated edges of said mounting panel.

* * * * *